US009273703B2

(12) United States Patent
Sweeney et al.

(10) Patent No.: US 9,273,703 B2
(45) Date of Patent: Mar. 1, 2016

(54) UNIVERSAL ORIENTATION ELECTRO-HYDRAULIC ACTUATOR

(75) Inventors: Timothy B. Sweeney, Osseo, MN (US); Matthew C. Royer, Minneapolis, MN (US)

(73) Assignee: Parker-Hannifin Corporation, Cleveland, OH (US)

( * ) Notice: Subject to any disclaimer, the term of this patent is extended or adjusted under 35 U.S.C. 154(b) by 713 days.

(21) Appl. No.: 13/234,609

(22) Filed: Sep. 16, 2011

(65) Prior Publication Data

US 2012/0067035 A1 Mar. 22, 2012

Related U.S. Application Data

(60) Provisional application No. 61/383,529, filed on Sep. 16, 2010.

(51) Int. Cl.

| | |
|---|---|
| ***F15B 11/00*** | (2006.01) |
| ***F15B 15/18*** | (2006.01) |
| ***F15B 21/04*** | (2006.01) |
| *F15B 1/26* | (2006.01) |

(52) U.S. Cl.

CPC ..... *F15B 15/18* (2013.01); *F15B 21/047* (2013.01); *F15B 1/265* (2013.01)

(58) Field of Classification Search

CPC ..... F15B 1/26; F15B 1/265; F15B 15/18; F15B 11/00; F15B 21/047

USPC ..... 60/477, 478

See application file for complete search history.

(56) References Cited

U.S. PATENT DOCUMENTS

| | | | | |
|---|---|---|---|---|
| 440,375 | A | 11/1890 | Smith | |
| 1,133,892 | A | 3/1915 | Swartz | |
| 1,429,795 | A | 9/1922 | Strom | |
| 1,993,612 | A | 3/1935 | Lum | |
| 2,619,182 | A | 11/1952 | Martin | |
| 2,631,431 | A | 3/1953 | Grebe | |
| 2,808,256 | A | 10/1957 | Landert | |
| 3,201,939 | A | 8/1965 | Gut | |
| 3,817,034 | A * | 6/1974 | Nott | 60/478 |
| 3,902,318 | A | 9/1975 | Becker et al. | |
| 5,595,103 | A * | 1/1997 | Ecoff et al. | 91/51 |
| 6,282,893 | B1 | 9/2001 | Porter et al. | |
| 6,519,939 | B1 * | 2/2003 | Duff | 60/473 |
| 7,047,733 | B1 | 5/2006 | Pecouyoul | |
| 7,055,317 | B2 * | 6/2006 | Knapp et al. | 60/413 |
| 7,640,736 | B2 | 1/2010 | Arbel et al. | |
| 2002/0026792 | A1 * | 3/2002 | Porter et al. | 60/478 |

FOREIGN PATENT DOCUMENTS

| | | | | |
|---|---|---|---|---|
| DE | 2128860 A1 * | 6/1971 | | F15B 7/02 |
| FR | 2489897 A * | 3/1982 | | F15B 15/18 |

* cited by examiner

*Primary Examiner* — Dwayne J White
*Assistant Examiner* — Matthew Wiblin
(74) *Attorney, Agent, or Firm* — Renner, Otto, Boisselle and Sklar, LLP

(57) ABSTRACT

An orientation-independent electro-hydraulic actuator that includes a housing having an interior space forming a fluid reservoir, a pump connected to the housing, an electric motor drivingly coupled to the pump; and a piston-cylinder assembly having a piston axially movable within a cylinder. The cylinder is in fluid communication with the pump to effect movement of the piston in response to fluid flow between the cylinder and the fluid reservoir. The pump has one or more inlet/outlet ports communicating with a volumetric centroid region of the fluid reservoir. The fluid reservoir includes a volume of hydraulic fluid such that when the piston is fully extended, the volume of fluid in the reservoir is at a minimum and at least one of the inlet/outlet ports is submerged in hydraulic fluid.

9 Claims, 7 Drawing Sheets

UNIVERSAL ORIENTATION ELECTRO-HYDRAULIC ACTUATOR

RELATED APPLICATIONS

This application claims the benefit of U.S. Provisional Application No. 61/383,529 filed Sep. 16, 2010, which is hereby incorporated herein by reference.

FIELD OF THE INVENTION

This invention relates to a self-contained power unit, and more particularly to an electro-hydraulic actuator that can be used in any orientation.

BACKGROUND OF THE INVENTION

Self-contained power units, such as electro-hydraulic actuators, are known. A typical electro-hydraulic actuator includes an electric motor that drives a hydraulic pump to move fluid between a reservoir and a hydraulic actuator. The hydraulic actuator generally includes a tubular barrel in which a piston having a piston rod moves linearly, back and forth. The piston seals and separates the inside of the barrel into two chambers, a fluid chamber and a piston chamber. The fluid chamber generally is filled with a substantially incompressible hydraulic fluid, typically an oil.

The pressure of hydraulic fluid pumped into or out of the fluid chambers moves the piston within the barrel. In general, when the electric motor is driven in a first rotational direction, the hydraulic pump moves the fluid into the fluid chamber of the hydraulic actuator and out of the piston chamber, thereby extending a piston rod from the actuator housing. When the electric motor is driven in a second rotational direction, opposite the first rotational direction, the hydraulic pump moves the hydraulic fluid out of the fluid chamber and into the piston chamber, thereby retracting the rod.

Some electro-hydraulic actuators have a hydraulic pump with two intake ports, both located at the bottom of the fluid reservoir. Depending on the end use of the electro-hydraulic actuator and its resulting orientation, one of the intake ports typically is plugged and the other intake port provides a path for fluid flow from the reservoir to the pump. As a result, these electro-hydraulic actuators require a change of components (i.e., the plug) depending upon its orientation at its end use.

An exemplary electro-hydraulic actuator has an external reservoir, thereby allowing it to be used in any orientation without changing components. The reservoir is connected to the pump intake or inlet port through a flexible tube with an affixed weight to ensure that the fluid pick-up end of the tube is always submerged, regardless of orientation. While this design represents a simplistic approach to providing universal orientation, the requirement for an external reservoir adds to the overall space claimed by the electro-hydraulic actuator. Additionally, for electro-hydraulic actuators that change orientations during use, the continuous movement of the flexible tube due to the weight may result in wear or premature failure.

SUMMARY OF THE INVENTION

The present invention provides an electro-hydraulic actuator (EHA) that overcomes the above mentioned issues, thereby providing an orientation-independent electro-hydraulic actuator. The EHA provided by the invention preferably at least one of (a) places the pump intake/outlet ports near a volumetric centroid of the fluid reservoir, and (b) includes a compressible gas chamber within the reservoir to accommodate changes in hydraulic fluid volumes. Both approaches serve to ensure that the intake/outlet ports of the pump remain submerged when the level of hydraulic fluid in the reservoir is at a minimum. The EHA provided by the invention also may include a tubular shield around the rotatable coupling between the pump and the electric motor. The shield separates the motion of the coupling from the fluid surrounding the shield, thereby minimizing or preventing the formation of vortices within the reservoir. Such vortices could interfere with the flow of fluid into and out of the reservoir.

More particularly, the present invention provides an electro-hydraulic actuator comprising a housing having an interior space forming a fluid reservoir; a pump connected to the housing, the pump having one or more inlet/outlet ports communicating with a volumetric centroid region of the fluid reservoir; an electric motor drivingly coupled to the pump; and a piston-cylinder assembly having a piston axially movable within a cylinder that is in fluid communication with the pump to effect movement of the piston in response to fluid flow between the cylinder and the reservoir. The fluid reservoir generally includes a volume of hydraulic fluid such that when the piston is fully extended, the volume of fluid in the reservoir is at a minimum and the inlet/outlet port is submerged in hydraulic fluid.

The present invention also provides an electro-hydraulic actuator comprising a housing having an interior space; a separation member separating the interior space into a first portion for containing a hydraulic fluid, and a second portion for containing a compressible gas; a pump connected to the housing, the pump having one or more inlet/outlet ports communicating with the first portion of the housing; and an electric motor drivingly coupled to the pump.

The separation member generally is shiftable between a first state defining a maximum volume of the first portion and a second state defining a minimum volume of the first portion, the separation member is biased by the compressed gas for shifting from the first state to the second state.

The present invention further provides an electro-hydraulic actuator comprising a housing having an interior fluid reservoir; a pump connected to the housing, the pump having one or more inlet/outlet ports communicating with the fluid reservoir; an electric motor coupled to the pump through a coupling extending into the fluid reservoir; and a tubular shield that surrounds the coupling within the reservoir to isolate motion of the coupling from the fluid in the reservoir surrounding the shield.

Additional features of the invention will become apparent from the following detailed description when considered in conjunction with the drawings.

DETAILED DESCRIPTION

The present invention provides an electro-hydraulic actuator (EHA) that is operable in any orientation without changing any components. In one embodiment, the EHA provided by the invention places the pump intake/outlet ports near a volumetric centroid region of the fluid reservoir. In another embodiment, or in combination with the first embodiment, the EHA includes a compressible gas chamber within the reservoir to accommodate changes in hydraulic fluid volumes. Both approaches serve to ensure that the intake/outlet ports of the pump remain submerged when the level of hydraulic fluid in the reservoir is at a minimum. The EHA provided by the invention also may include a tubular shield within the reservoir around the rotatable coupling between the pump and the electric motor. The shield separates the motion of the coupling from the fluid surrounding the shield, thereby minimizing or preventing the formation of vortices within the reservoir that might interfere with the flow of fluid into and out of the reservoir.

Turning now to a detailed description of an exemplary EHA provided in accordance with the invention, FIGS. 1A-1F illustrate the EHA 10 in six different orientations in which the EHA 10 is operable. No changes to the EHA 10 are necessary to enable it to operate in a different orientation. Consequently, the EHA 10 also can operate in conditions where its orientation changes over time. In other words, the EHA 10 can continue to operate as it moves through a range of motion that encompasses one or more of the illustrated static orientations, or other orientations therebetween.

Figure 1A:
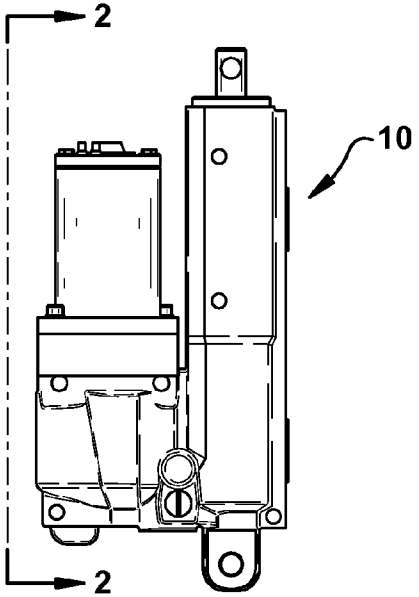
FIGS. 1A-1F illustrate six different orientations for operation of an electro-hydraulic actuator provided by the present invention.
Figure 1B:
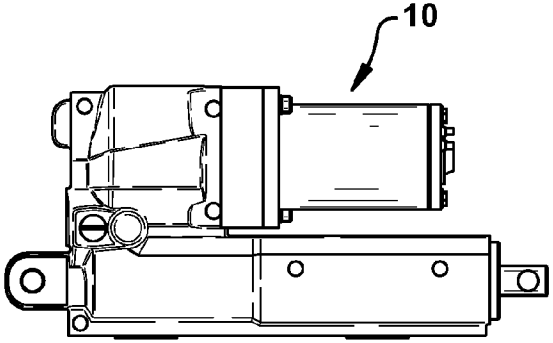
Figure 1C:
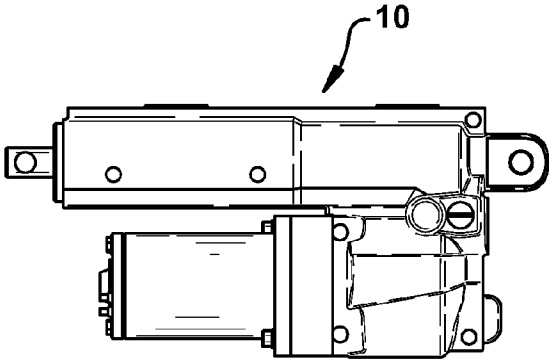
Figure 1D:
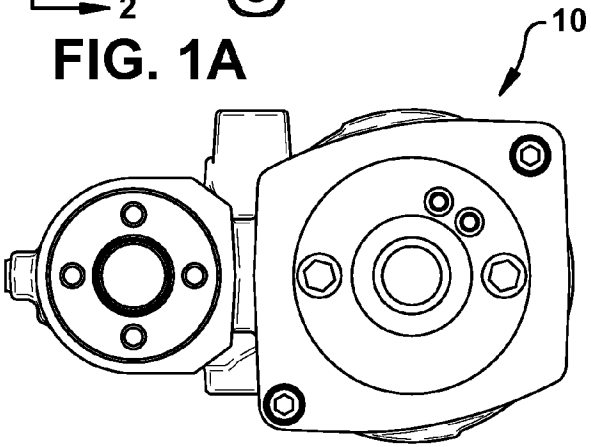
Figure 1E:
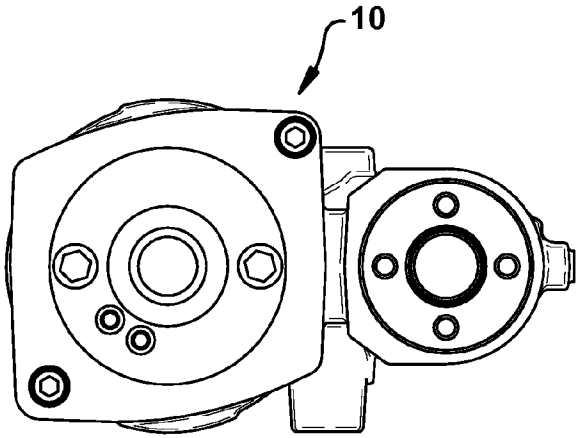
Figure 1F:
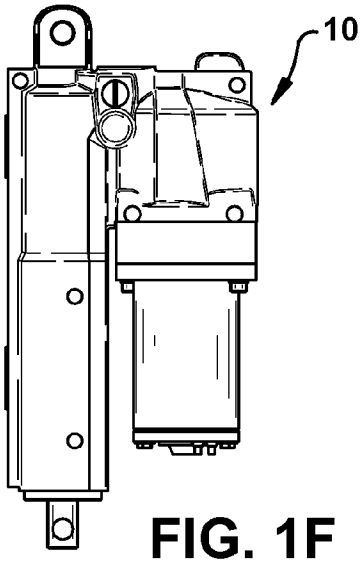
Figure 2:
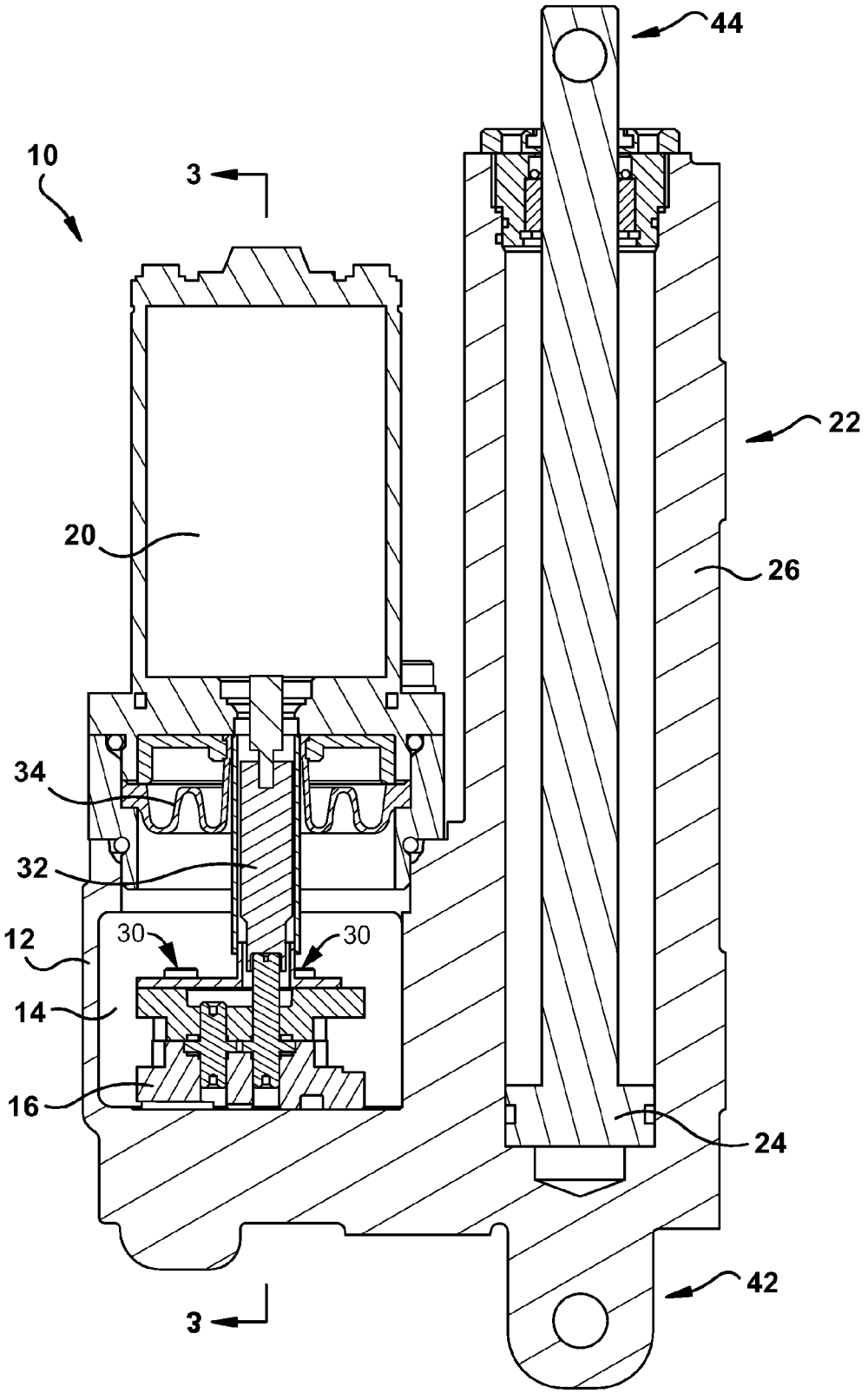
FIG. 2 is a cross-sectional view of the electro-hydraulic actuator of FIG. 1A, as seen along lines 2-2.
Figure 3:
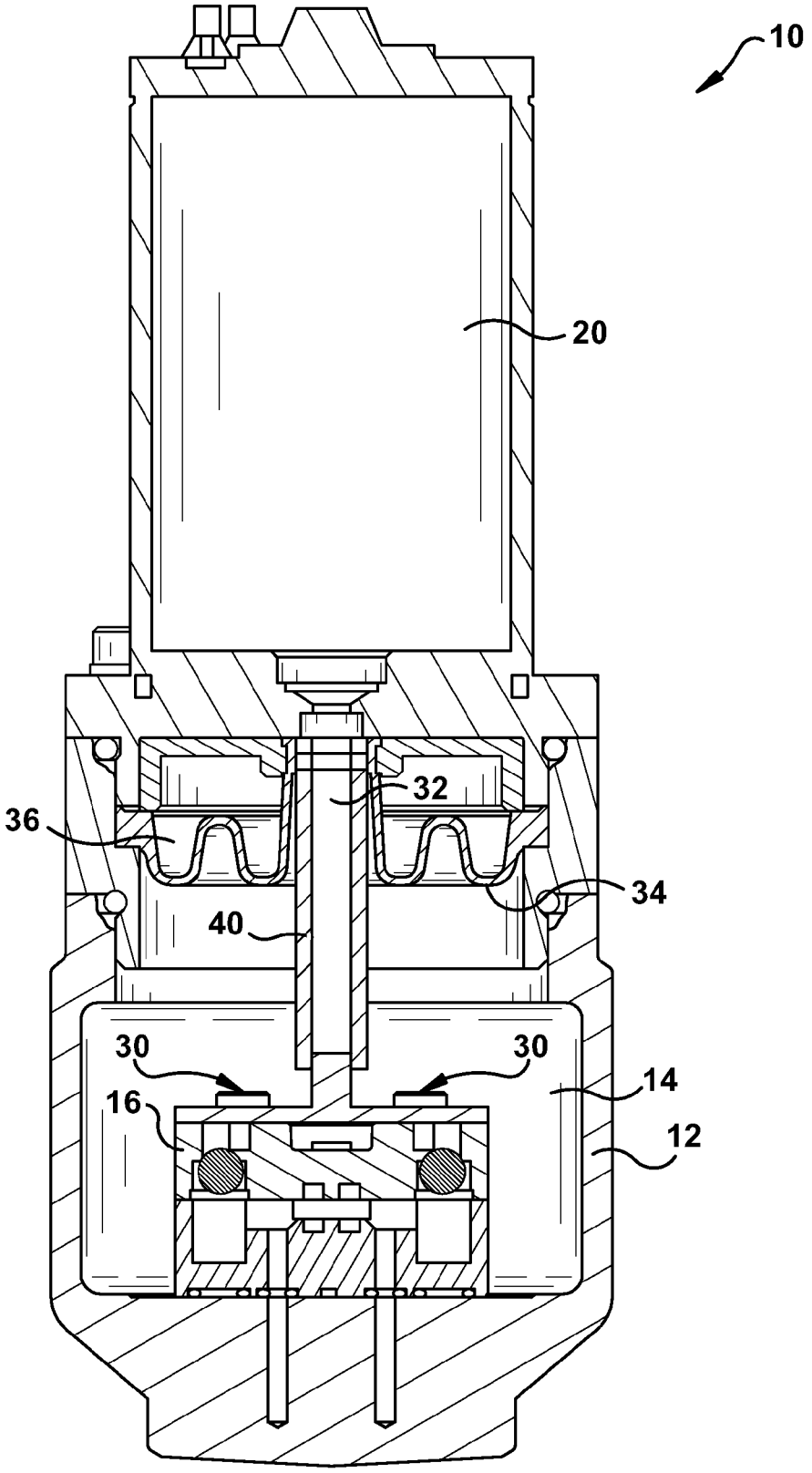
FIG. 3 is a cross-sectional view of the electro-hydraulic actuator of FIG. 2, as seen along lines 3-3 with a reservoir portion in a maximum fluid volume condition.
Figure 4:
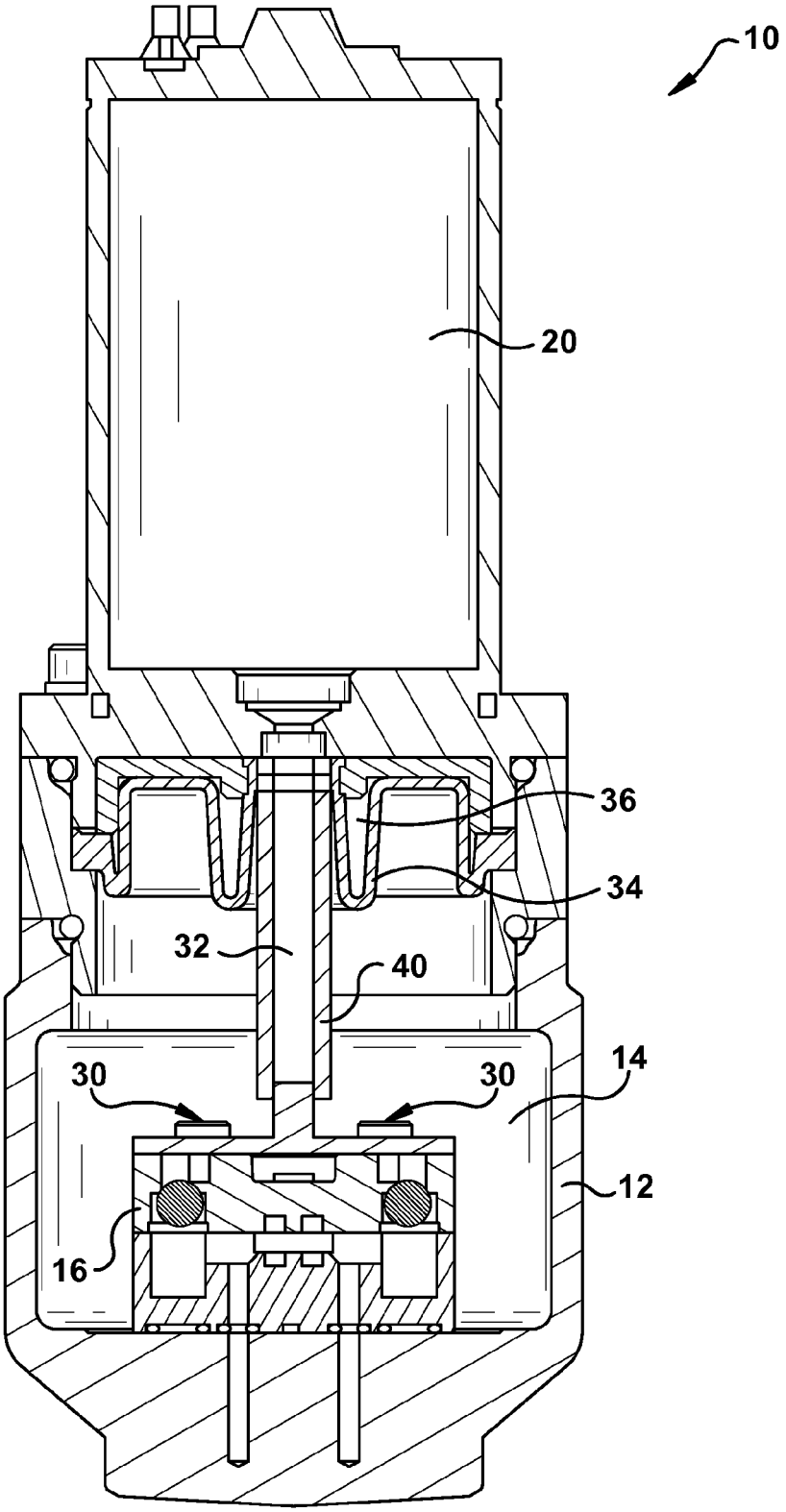
FIG. 4 is a cross-sectional view of the electro-hydraulic actuator of FIG. 3 with a reservoir portion in a minimum volume condition

More particularly, referring now to FIGS. 2-4, the illustrated EHA 10 includes a housing 12 having an interior space or other means for forming a fluid reservoir 14, a pump or other means for moving fluid 16 connected to the housing 12, an electric motor or other motive means 20 drivingly coupled to the pump 16, and a piston-cylinder actuator assembly 22 having a piston 24 axially movable within a cylinder 26 that is in fluid communication with the pump 16 to effect movement of the piston 24 in response to fluid flow between the cylinder 26 and the pump 16. An exemplary pump is a gerotor pump. Other hydraulic actuating means for effecting movement in response to fluid flow can be used in place of such a piston-cylinder actuator assembly. A coupling 32 connects the electric motor 20 to the pump 16. The coupling 32, which can include a drive shaft, for example, extends into the reservoir 14 and connects to the pump 16 near the inlet/outlet ports 30.

In the illustrated embodiment, the pump 16 is located within the housing 12, and can be considered to be inside the fluid reservoir 14. Alternatively, the pump 16 can be mounted to the housing 12 outside the reservoir 14, including outside the housing 12. The fluid reservoir 14 generally includes a volume of hydraulic fluid such that when the piston 24 is fully extended, the volume of fluid in the reservoir 14 is at a minimum and at least one of the inlet/outlet ports 30 is submerged in hydraulic fluid.

Figure 5:
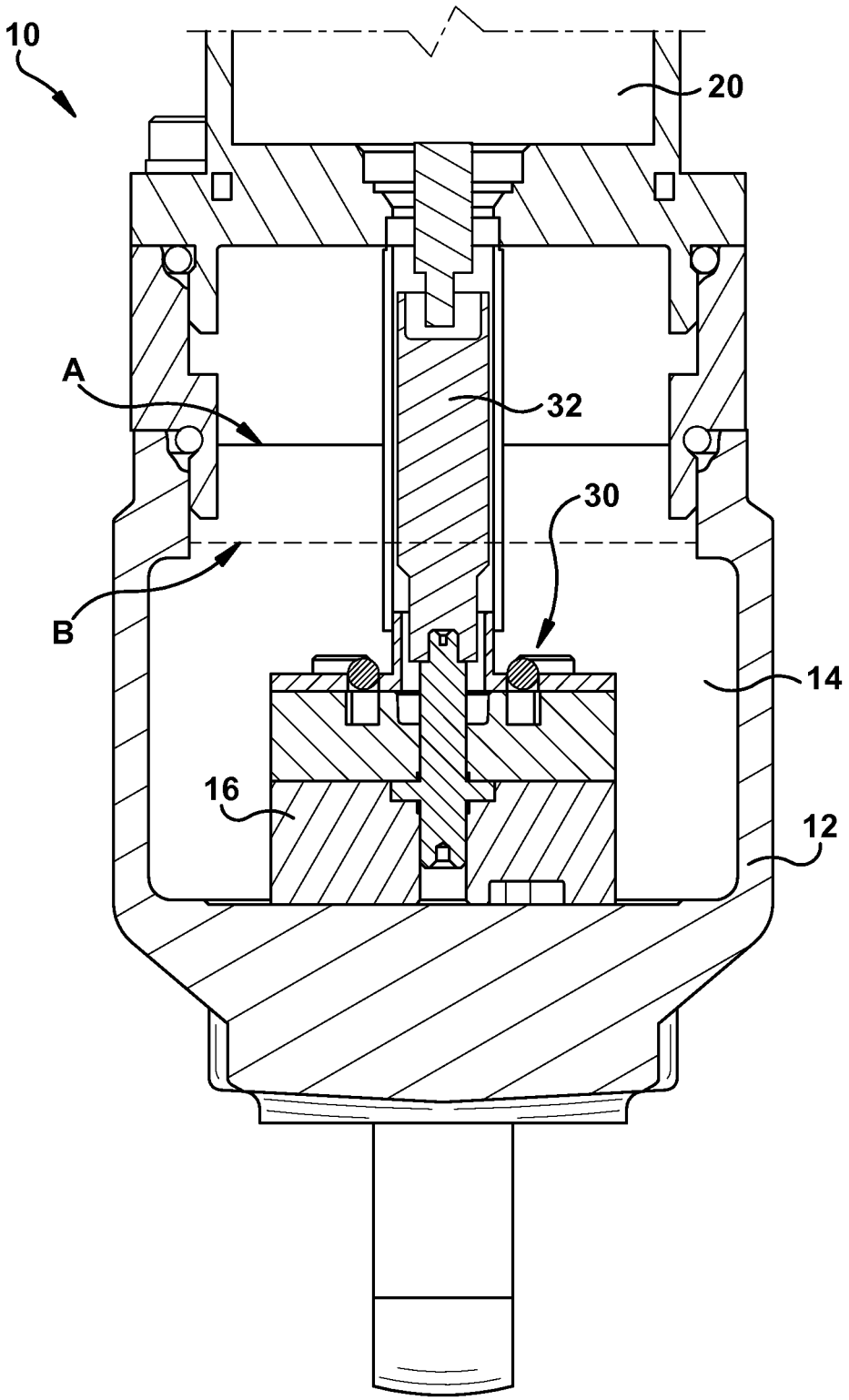
FIG. 5 is an enlarged view of a reservoir portion of another exemplary electro-hydraulic actuator similar to that shown in FIGS. 3 and 4.

Due to the differential volume of hydraulic fluid in the cylinder 26 between extended and retracted states of the piston 24, a pocket of air (or other compressible gas) is located inside the housing 12 to accommodate the varying volumes of oil in the reservoir 14. Thus the volume of the compressible gas is related to the position of the piston 24 in the cylinder 26. For example, as the piston 24 moves from a fully extended condition to a fully retracted condition, the volume of the compressible gas within the housing 12 is compressed, as shown by line A in FIG. 5, and the reservoir 14 pressure increases. Similarly, as the piston 24 moves from the fully retracted condition to the fully extended condition, the volume of the compressible gas in the housing 12 expands, as shown by line B in FIG. 5, and the reservoir 14 pressure decreases. The maximum internal reservoir pressure generally is limited by the ability of a seal on the motor drive shaft or other coupling 32 therebetween to maintain a seal and retain the hydraulic fluid in the reservoir 14. This typically results in an appreciable volume of compressible gas being used in the housing 12 to compensate for the differential volume in the cylinder 26 in conjunction with movement of the piston 24.

Further, various stroke length and piston diameter offerings for the EHA 10 result in varying volumes of compressible gas being used. Regardless of the application, the pump intlet/outlet port 30 should be submerged in hydraulic fluid and not be exposed to the pocket of compressible gas. Exposing the inlet/outlet port 30 to the pocket of compressible gas could result in the pump 16 introducing the compressible gas into the hydraulic circuit. That can lead to compressibility in the cylinder 26 and ultimately may compromise the safety and reliability of the EHA 10.

To permit the EHA 10 to be used in any orientation, the pump 16 has one or more inlet/outlet ports 30 communicating with a volumetric centroid region 31 of the fluid reservoir 14. Thus, when the volume of fluid in the reservoir 14 is at a minimum (when the fluid has been moved to the cylinder 24 to extend the piston 24), the inlet/outlet ports 30 remain submerged in fluid. Each of the centrally-located inlet/outlet ports 30 is located within the internal reservoir 14, which may be optimized in size and shape to ensure that the inlet/outlet ports 30 are submerged in hydraulic fluid regardless of orientation of the EHA 10 and regardless of the piston diameter-stroke length combinations.

The motor 20 and the pump 16 are reversible, whereby reversing the motor 20 reverses the direction in which the pump 16 moves the fluid. When the pump 16 is moving hydraulic fluid, typically an oil, from the reservoir 14 to the cylinder 26, the ports 30 act as inlet or intake ports. When the pump 16 is moving hydraulic fluid from the cylinder 26 to the reservoir 14, the ports 30 act as outlet ports.

The illustrated embodiment of the EHA 10 provided by the invention also includes a separation member 34 within the housing 12 to separate hydraulic fluid in the reservoir 14 from a volume of compressible gas. Specifically, the separation member 34 separates the interior space in the housing 12 into a first portion for containing a hydraulic fluid (the reservoir 14), and a second portion 36 for containing a compressible gas. The pump 16 is connected to the housing 12 and one or more of the inlet/outlet ports 30 communicate with the first portion (reservoir 14) of the housing 12. The separation member 34 is shiftable, movable or deformable, between a first state defining a maximum volume of the first portion (FIG. 4) and a second state defining a minimum volume of the first portion (FIG. 3). The separation member 34 is biased to the first state by the compressed gas for shifting from the first state to the second state.

The separation member 34 generally is made of a flexible material that is impermeable to the compressible gas. Most, if not all, of the compressible gas in the housing 12 is contained within or on one side of the separation member 34 in the second portion 36 of the housing 12. The separation member 34 keeps the volume of compressible gas isolated from the pump inlet/outlet ports 30. To retract the piston 24 within the cylinder 26, the pump 16 moves (pumps) hydraulic fluid from the cylinder 26 into the reservoir 14, and the separation member 34 contracts as the gas is compressed to the state shown in FIG. 4. To extend the piston 24, the pump 16 moves (pumps) hydraulic fluid from the reservoir 14 to the cylinder 26, whereupon the gas expands and the separation member 34 relaxes and returns to its original shape or position as shown in FIG. 3.

Figure 6A:
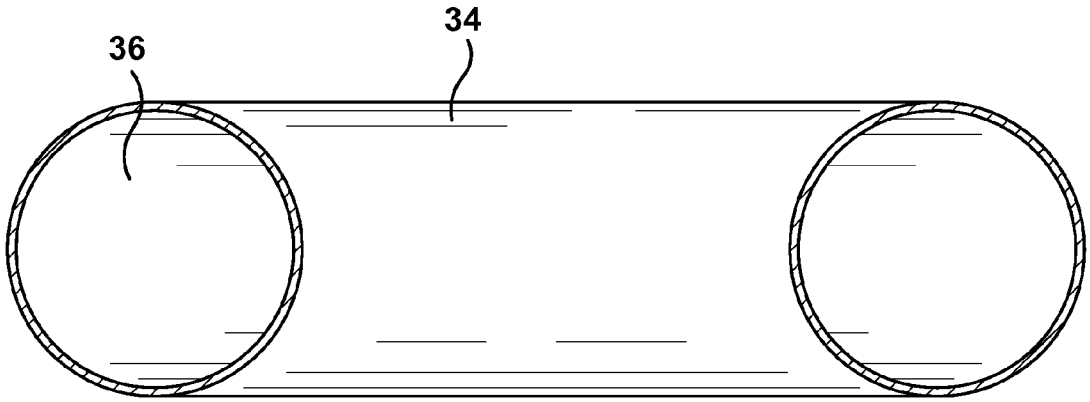
FIGS. 6A and 6B illustrate a compressible gas separation member for use with the electro-hydraulic actuator provided by the present invention.
Figure 6B:
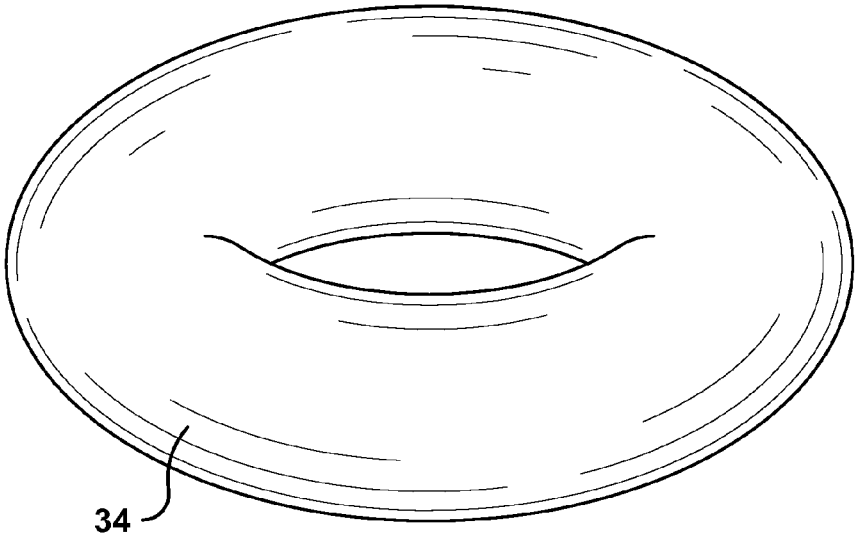
Figure 7A:
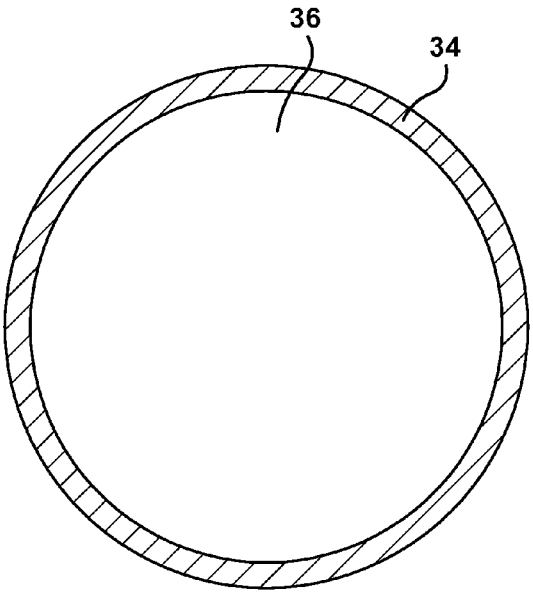
FIGS. 7A and 7B illustrate an alternative compressible gas separation member for use with the electro-hydraulic actuator provided by the present invention.
Figure 7B:
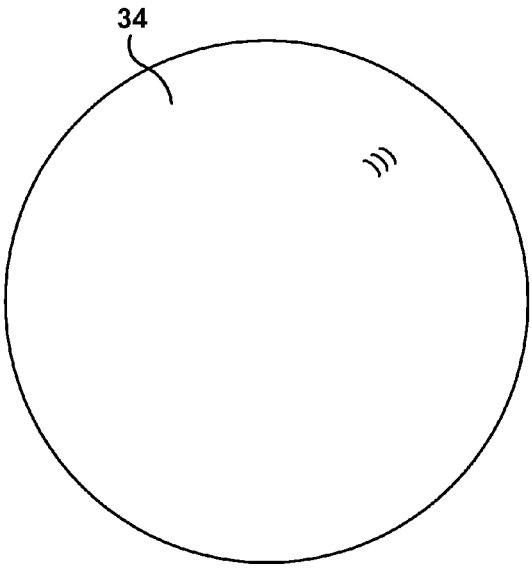
Figure 8A:
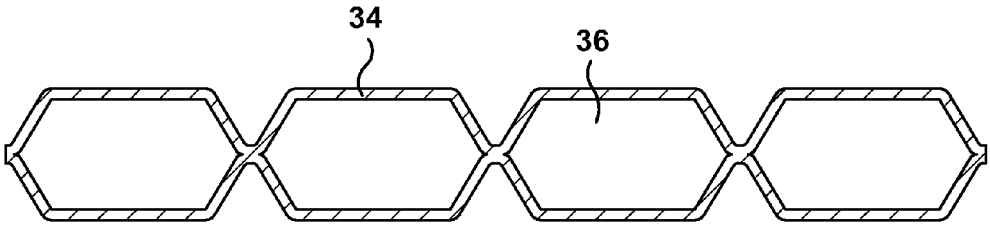
FIGS. 8A and 8B illustrate an alternative compressible gas separation member for use with the electro-hydraulic actuator provided by the present invention.
Figure 8B:
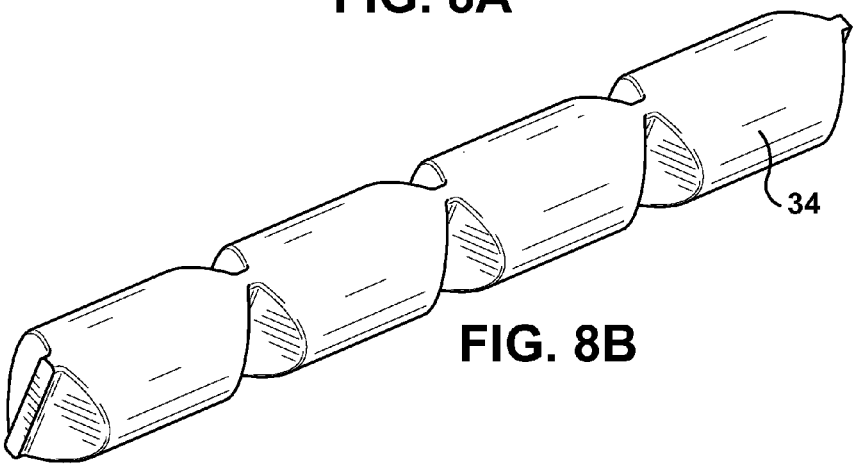

The separation member 34 can take different forms. Proposed forms of the separation member 34 may include any one or more of the following designs: diaphragm (FIG. 3), torus-shaped bladder (FIGS. 6A and 6B), spherical bladder (FIGS. 7A and 7B), or segmented bladder (FIGS. 8A and 8B). Each of the separation member designs offers unique benefits and challenges: the torus, segmented, and spherical bladders are drop-in solutions, but are a challenge to manufacture. In comparison, the diaphragm offers the most attractive solution in terms of manufacturability, but likely would require some assembly into the housing 12.

The present invention also provides an electro-hydraulic actuator 10 having a housing 12, a pump 16, and an electric motor 20, as described above, and a tubular shield 40 that surrounds the coupling 32 within the reservoir 14, separating the coupling 32 inside the shield 40 from the inlet/outlet ports 30 outside the shield. The shield 40 allows the centrally-located inlet/outlet ports 30 and the coupling 32 to be located close together. Without the coupling shield 40, the close proximity of the pump inlet or intake ports 30 to a rotating coupling 32 could result in the coupling 32 creating a vortex that would interfere with the flow of hydraulic fluid into the pump inlet ports 30. The shield 40 prevents the creation of such a vortex by isolating the hydraulic fluid surrounding the shield 40 from the coupling's rotation. Thus, where the coupling 32 passes through the fluid reservoir 14, the shield 32 isolates motion of the motor-pump coupling 32 from the fluid in the reservoir 14 that surrounds the shield 40. Of course, if the shield 40 is not sealed, the shield 40 would not isolate the motion of the coupling 32 from hydraulic fluid inside the shield 40, but vortices created inside the shield would not disrupt fluid flow into the inlet/outlet ports 30 outside the shield 40.

A universal orientation EHA solution is obtainable with any of the described embodiments, or a combination thereof. The central inlet/outlet ports 30 of the pump 16, combined with the use of the separation member 34 and compressible gas, allows for flexibility. This is attractive in terms of the manufacturability of the EHA 10 as it does not drive the need for costly purging processes in assembly. In addition, using the central inlet/outlet ports 30 alone or in parallel with a separation member 34 for the compressible gas provides an improved level of safety, particularly in applications requiring a large range of motion when the EHA 10 is operating, by keeping the compressible gas away from the pump's inlet ports 30.

The described embodiments provide improvements over the existing EHA designs. As should be apparent from the preceding description, the EHA 10 provided by the present invention is a self-contained power unit that has a compact, unitary assembly. Such a compact design also results in the reduction, if not elimination, of potential paths of ingress for contaminants and potential leak points that plague many hydraulic systems having traditional hoses and fittings. As a self-contained power unit, the EHA 10 has a closed-loop hydraulic circuit with an internal, pressurized reservoir 14 to deliver fluid to a submerged pump 16 for extending and retracting the actuator cylinder rod 24.

Further, with the direct interface between the electric motor 20 and the pump 16 through the internal reservoir 14, all of the components of the EHA 10 can be located between the ends of the piston-cylinder assembly. Compared to competitive EHAs, the universal orientation solutions described herein allow the EHA 10 provided by the invention to minimize the maximum dimensions of the EHA (typically the dimension between a mounting bracket 42 portion of the cylinder 26 and a connecting pin 44 at the distal end of the piston 24 as seen in FIG. 2) and offer one of the most power dense self-contained EHA solutions suitable for universal orientation.

In summary, the present invention provides an orientation-independent electro-hydraulic actuator 10 that includes a housing 12 having an interior space forming a fluid reservoir 14, a pump 16 connected to the housing 12, an electric motor 20 drivingly coupled to the pump 16; and a piston-cylinder assembly 22 having a piston 24 axially movable within a cylinder 26. The cylinder 26 is in fluid communication with the pump 16 to effect movement of the piston 24 in response to fluid flow between the cylinder 26 and the fluid reservoir 14. The pump 16 has one or more inlet/outlet ports 30 communicating with a volumetric centroid region of the fluid reservoir 14. The fluid reservoir 14 includes a volume of hydraulic fluid such that when the piston 24 is fully extended, the volume of fluid in the reservoir 14 is at a minimum and at least one of the inlet/outlet ports 30 is submerged in hydraulic fluid.

The present invention thus provides an electro-hydraulic actuator that incorporates one or more of the features set forth in the following clauses.

A. An electro-hydraulic actuator 10 comprising:

a housing 12 having an interior space forming a fluid reservoir 14;

a pump 16 connected to the housing 12, the pump 16 having one or more inlet/outlet ports 30 communicating with a volumetric centroid region of the fluid reservoir 14;

an electric motor 20 drivingly coupled to the pump 16; and a piston-cylinder assembly 22 having a piston 24 axially movable within a cylinder 26 that is in fluid communication with the pump 16 to effect movement of the piston 24 in response to fluid flow between the cylinder 26 and the reservoir 14.

B. An actuator 10 as set forth in clause A or any other clause depending from clause A, where a coupling 32 connects the electric motor 20 to the pump 16, and the inlet/outlet ports 30 are located adjacent the coupling 32.

C. An actuator 10 as set forth in clause A or any other clause depending from clause A, where the pump 16 is located within the housing 12.

D. An actuator 10 as set forth in clause A or any other clause depending from clause A, where the fluid reservoir 14 includes a volume of hydraulic fluid such that when the piston 24 is fully extended, the volume of fluid in the reservoir 14 is at a minimum and the inlet/outlet port 30 is submerged in hydraulic fluid.

E. An actuator 10 as set forth in clause A or any other clause depending from clause A, including a separation member 34 within the housing 12 that separates hydraulic fluid in the reservoir 14 from a volume of compressible gas.

F. An actuator 10 as set forth in clause E or any other clause depending from clause E, where the separation member 34 includes at least one of a diaphragm, a torus-shaped bladder, a segmented bladder, and a spherical bladder.

G. An actuator 10 as set forth in clause A or any other clause depending from clause A, where the electric motor 20 is coupled to the pump 16 through a coupling 32, the coupling 32 extends into the reservoir 14 and connects to the pump 16 near the inlet/outlet port 30.

H. An actuator 10 as set forth in clause G or any other clause depending from clause G, including a tubular shield 40 that surrounds the coupling 32 within the reservoir 14 to isolate motion of the coupling 32 from the fluid within the reservoir 14 that surrounds the shield 40.

I. An actuator 10 as set forth in clause A or any other clause depending from clause A, where the motor 20 and the pump 16 are reversible, whereby reversing the motor 20 reverses the direction in which the pump 16 moves the fluid.

J. An electro-hydraulic actuator 10 comprising:

a housing 12 having an interior space;

a separation member 34 separating the interior space into a first portion 14 for containing a hydraulic fluid, and a second portion for containing a compressible gas;

a pump 16 connected to the housing, the pump 16 having one or more inlet/outlet ports 30 communicating with the first portion 14 of the housing 12; and an electric motor 20 drivingly coupled to the pump 16.

K. An actuator 10 as set forth in clause J or any other clause depending from clause J, where the separation member 34 is shiftable between a first state defining a maximum volume of the first portion 14 and a second state defining a minimum volume of the first portion 14, the separation member 34 is biased by the compressed gas for shifting from the first state to the second state.

L. An actuator 10 as set forth in clause J or any other clause depending from clause J, wherein the separation member 34 includes at least one of a diaphragm, a torus-shaped bladder, a segmented bladder, and a spherical bladder.

M. An actuator 10 as set forth in clause J or any other clause depending from clause J, comprising a piston-cylinder assembly 22 having a piston 24 axially movable within a cylinder 26 that is in fluid communication with the pump 16 to effect movement of the piston 24 in response to fluid flow between the cylinder 26 and the reservoir 14.

N. An actuator 10 as set forth in clause M or any other clause depending from clause M, where the fluid reservoir 14 includes a volume of hydraulic fluid such that when the piston 24 is fully extended, the volume of fluid in the reservoir 14 is at a minimum and the inlet/outlet port 30 is submerged in hydraulic fluid.

O. An electro-hydraulic actuator 10 comprising:

a housing 12 having an interior fluid reservoir 14;

a pump 16 connected to the housing 12, the pump 16 having one or more inlet/outlet ports 30 communicating with the fluid reservoir 14;

an electric motor 20 coupled to the pump 16 through a coupling 32 extending into the fluid reservoir 14; and a tubular shield 40 that surrounds the coupling 32 within the reservoir 14 to isolate motion of the coupling 32 from the fluid in the reservoir 14 surrounding the shield 40.

P. An actuator 10 as set forth in clause O or any other clause depending from clause O, where the pump 16 is located within the housing 12 and has an inlet/outlet port 30 in communication with a volumetric centroid region of the reservoir 14, and the coupling 32 connects to the pump 16 near the inlet/outlet port 30.

Q. An actuator 10 as set forth in clause O or any other clause depending from clause O, comprising a piston-cylinder assembly 22 having a piston 24 axially movable within a cylinder 26 that is in fluid communication with the pump 16 to effect movement of the piston 24 in response to fluid flow between the cylinder 26 and the reservoir 14.

R. An actuator 10 as set forth in clause Q or any other clause depending from clause Q, where the fluid reservoir 14 includes a volume of hydraulic fluid such that when the piston 24 is fully extended, the volume of fluid in the reservoir 14 is at a minimum and the inlet/outlet port 30 is submerged in hydraulic fluid.

S. An actuator 10 as set forth in clause O or any other clause depending from clause O, including a separation member 34 within the housing 12 that separates hydraulic fluid in the reservoir 14 from a volume of compressible gas.

T. An actuator 10 as set forth in clause S or any other clause depending from clause S, where the separation member 34 includes at least one of a diaphragm, a torus-shaped bladder, a segmented bladder, and a spherical bladder.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An electro-hydraulic actuator comprising:

a housing having walls that define an interior space forming a fluid reservoir;

a pump connected to the housing, the pump having an inlet port and an outlet port located on a surface of the pump, each of the inlet port and the outlet port facing a volumetric centroid region of the fluid reservoir and the inlet port and the outlet port are spaced from the walls of the housing;

an electric motor drivingly coupled to the pump to drive the pump; and a piston-cylinder assembly having a piston axially movable within a cylinder that is in fluid communication with the pump to effect movement of the piston in response to fluid flow between the cylinder and the reservoir.

2. An actuator as set forth in claim 1, where a coupling connects the electric motor to the pump, and the inlet port and the outlet port are located adjacent the coupling.

3. An actuator as set forth in claim 1, where the pump is located within the housing.

4. An actuator as set forth in claim 1, where the fluid reservoir includes a volume of hydraulic fluid such that when the piston is fully extended, the volume of fluid in the reservoir is at a minimum and the inlet port and the outlet port are submerged in hydraulic fluid.

5. An actuator as set forth in claim 1, including a separation member within the housing that separates hydraulic fluid in the reservoir from a volume of compressible gas.

6. An actuator as set forth in claim 5, where the separation member includes one of a diaphragm, a torus-shaped bladder, a segmented bladder, and a spherical bladder.

7. An actuator as set forth in claim 1, where the electric motor is coupled to the pump through a coupling, the coupling extends into the reservoir and connects to the pump near the inlet port and the outlet port.

8. An actuator as set forth in claim 7, including a tubular shield that surrounds the coupling within the reservoir to isolate motion of the coupling from the fluid within the reservoir that surrounds the tubular shield.

9. An actuator as set forth in claim 1, where the motor and the pump are reversible, whereby reversing the motor reverses the direction in which the pump moves the fluid.

* * * * *